US005212332A

United States Patent [19]

Gigliotti

[11] Patent Number: 5,212,332

[45] Date of Patent: May 18, 1993

[54] SWAB FOR WIND INSTRUMENTS

[76] Inventor: Anthony M. Gigliotti, 48 N. Syracuse Dr., Cherry Hill, N.J. 08034

[21] Appl. No.: 729,564

[22] Filed: Jul. 15, 1991

[51] Int. Cl.[5] ..... G10G 7/00; A47K 7/02

[52] U.S. Cl. ..... 84/453; 15/211; 15/222

[58] Field of Search ..... 84/453; 15/222, 211, 15/208

[56] References Cited

U.S. PATENT DOCUMENTS 1,730,785 10/1929 Romao ..... 15/211
3,739,420 6/1973 Kafkis ..... 84/453
4,016,622 4/1977 Eisenman ..... 15/222
4,114,504 9/1978 Koregelos ..... 84/453
4,967,439 11/1990 LaLonde ..... 84/453

*Primary Examiner*—Michael L. Gellner
*Assistant Examiner*—Cassandra Spyrou
*Attorney, Agent, or Firm*—Walter B. Udell

[57] ABSTRACT

An improved swab for wind instruments for removing accumulated deposits of condensation within the instrument which if not removed can change the instrument tone, and in severe cases destroy sound production, producing a hiss or gurgling sound instead of a tone. The swab is made of highly absorbent silk, is not subject to jamming within the instrument, forcing moisture into the tone holes of the instrument, or leaving lint within the instrument, and includes a jam releasing pull-out tail.

7 Claims, 2 Drawing Sheets

FIG. 1
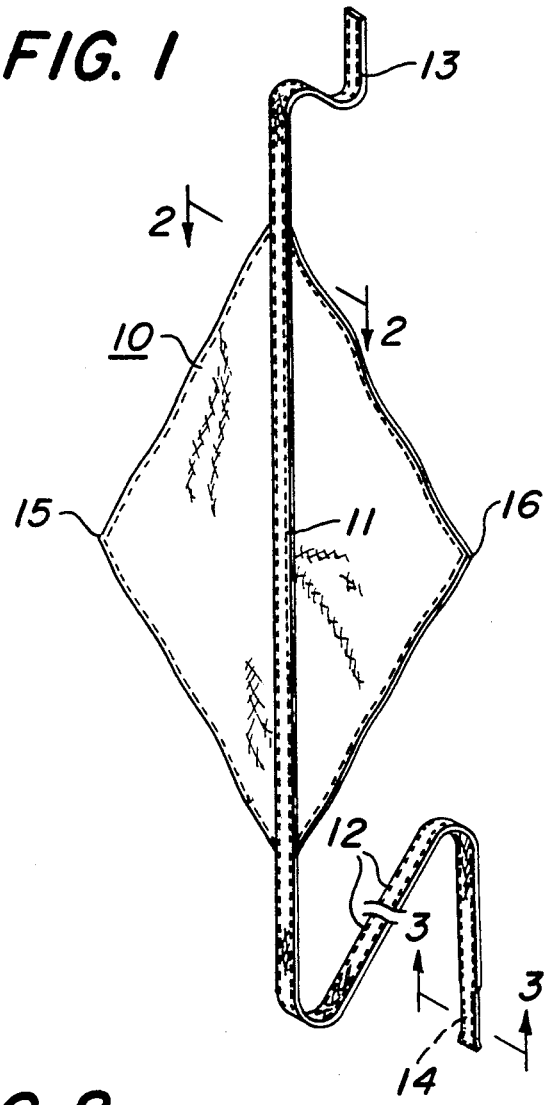
FIG. 2
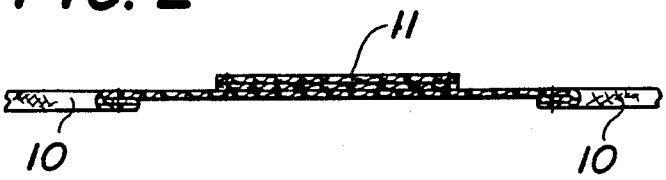
FIG. 3
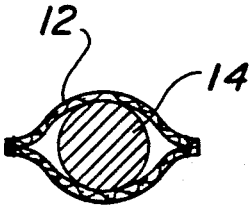
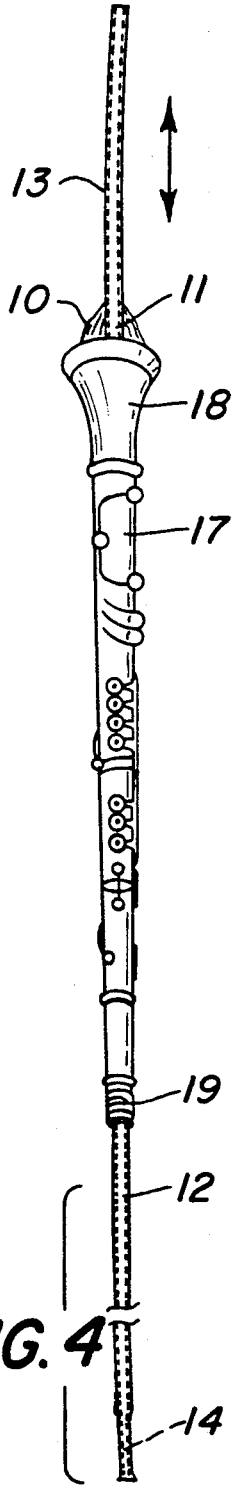
FIG. 4

FIG. 5
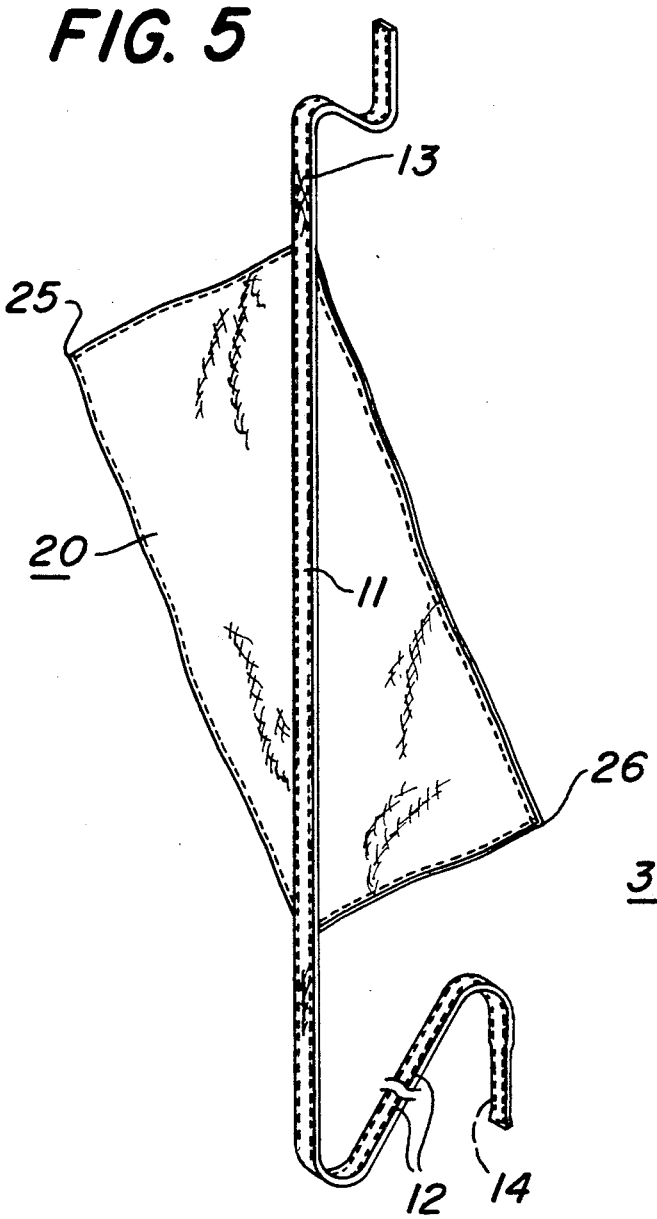
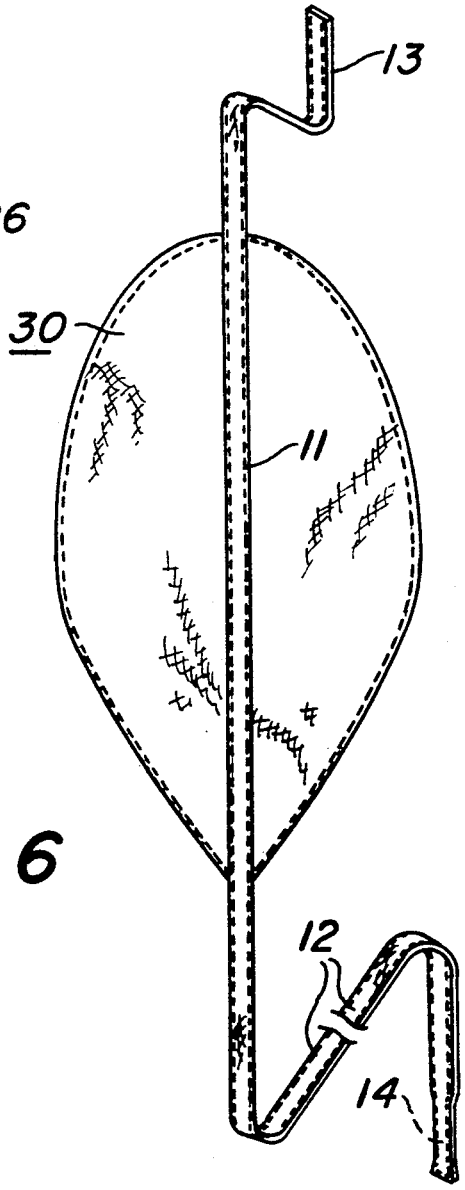
FIG. 6

SWAB FOR WIND INSTRUMENTS

This invention relates generally to swabs for musical instruments, and more particularly relates to an improved swab for single reed instruments such as clarinets and for double reed instruments such as bassoon, oboe and English horn.

Wind instruments which are played for any period of time, as for example during a symphonic concert, gradually accumulate deposits of condensation within the instrument which if not removed can change the instrument tone, and in severe cases destroy sound production, producing a hiss or gurgling sound instead of a tone. To prevent such conditions, which are not tolerable, instrument swabs for removing condensation from the interior of instruments have been used for a very long time. These swabs have in the past been made of absorbent fabric such as cotton, and while being generally satisfactory have sometimes caused some serious problems. One such problem is that, on occasion, the swab has become jammed within the instrument and prevented the instrument from being played. Another problem is that such swabs have been found to sometimes force moisture into the tone holes of the instrument and thereby causing a tone shift, and in severe cases involving covered hole instruments can destroy the sound production and produce a hiss or gurgle. Moreover, cotton swabs have a tendency to leave lint within the instrument which also adversely affects tone production.

The novel swab according to the invention eliminates the foregoing problems due to several features. First, the swab is made of a washable silk, such as crepe de chine, instead of cotton. The silk material is non-linting, more absorbent than cotton and dries out much faster, so that it is only necessary to use one such swab during a concert instead of needing several. Moreover, the surface characteristics of silk are such that it slides through the instrument much more easily than does cotton and does not force moisture into the tone holes. A second important feature of the novel swab according to the invention is that it has a reverse pull-out tail by means of which the swab may be reversely pulled jam, thus avoiding the possibility of having the instrument become useless during a concert. Finally, in the past the shape of the absorbent portion of the swab has been square with the swab pulled through the instrument along a diagonal of the square. This creates a maximum bulge or thickness at one point along the length of the swab and contributes to the jamming problem. By utilizing different shapes for the swab absorbent section, it is possible to drastically reduce, if not altogether eliminate, the jamming problem. Accordingly, it is a primary object of the invention to provide a novel wind instrument swab not subject to the limitations of cotton swabs, such as linting, jamming and causing shifts in tone production.

Another object of the invention is to provide a novel wind instrument swab as aforesaid which is made of a washable silk material which passes more smoothly through the instrument and has a much more rapid drying time than cotton.

A further object of the invention is to provide a novel wind instrument swab as aforesaid which includes at its top end an elongated reverse pull-out tail to provide a means for releasing any swab jam which might occur.

Yet another object of the invention is to provide a novel wind instrument swab as aforesaid in which the swab shape departs from the standard square pattern of swabs used in the past, and utilizes other swab body configurations such as rectangles ellipses.

The foregoing and other objects of the invention will become clear from a reading of the following specification in conjunction with an examination of the appended drawings, wherein:

FIG. 1 illustrates the novel swab according to the invention with a standard square swab body;

FIG. 2 is a cross section, on an enlarged scale, through the swab of FIG. 1 as would be seen when viewed along the line 2—2 of FIG. 1;

FIG. 3 is a cross section on an enlarged scale through the weighted lower end of the swab tail as would be seen when viewed along the line 3—3 on FIG. 1;

FIG. 4 illustrates the swab according to the invention inserted through a clarinet for purposes of illustration;

FIG. 5 shows another embodiment of the invention in which the body of the swab is rectangular instead of square; and FIG. 6 illustrates another variation of the invention in which the swab body is of modified elliptical shape.

In the several figures, like elements are denoted by like reference characters.

Referring now to the drawings, and firstly to FIGS. 1, 2 and 3, there is seen the novel swab according to the invention which includes a swab body 10 made of washable silk, hemmed along its edges, and of generally square shape. Fixedly secured to the swab body 10 along a diagonal of the body square is a swab drawstrip 11 which is secured along an intermediate portion of its length continuously to the swab body 10, and which has a leading tail 12 and a following tail 13. Secured within the lower terminal end of the leading tail 12 is a weight 14.

As seen in the showing of FIG. 4, the swab is illustrated in connection with the cleaning of a clarinet 17 having a lower end bell 18 and an upper end barrel 19 with the clarinet mouthpiece removed and not shown. In use, the weighted leading end 12 is dropped into the bell 18 and moves by gravity under influence of the weight 14 through the body of the clarinet 17 and emerges at the barrel 19. When the weighted end of the leading tail 12 emerges from the barrel, it is grasped with the hand and pulled downward to cause the swab body 10 to compress radially inward as it moves into the body of the instrument. The leading tail is pulled smoothly downward which draws the swab body and the following tail 13 through the instrument and out the barrel end, absorbing the moisture within the instrument on its passage through the instrument body. Sometimes it is desirable to pass the swab through the instrument a second time to insure complete removal of all moisture. In the unlikely event that the body of the swab jammed within the body of the instrument after it had passed thereinto, there still remains above the bell 18 a portion of the following tail 13 which may be firmly grasped and back pulled to release the swab body from the inside of the instrument. The known instrument swabs do not include a following tail 13, so that once the body of the swab has entered the body of the instrument it is very difficult to retrieve it if it should become wedged or jammed. The presence of the following tail 13 in the swab according to the invention eliminates this problem.

One potential cause of jamming within the body is the fact that the free corners 15 and 16 of the conventional square swab body 10 shown in FIG. 1 are exactly positionally opposite one another and compress toward one another when the swab is drawn through the instrument. This puts the major bulk of the swab into a relatively small portion of the swab length, and, under conditions of swelling do to moisture expansion can sometimes result in a high friction passage or tendency toward wedging. This difficulty is avoidable by utilizing alternative swab body shapes as for example shown in FIGS. 5 and 6 to which reference should be now made.

FIG. 5 illustrates a swab body 20 of rectangular shape affixed to a drawstrip 11, which can be identical to that shown in FIG. 1. It will be observed that the free corners 25 and 26 of the rectangular swab body 20 are not opposite one another, and as the swab is drawn through the instrument, there is almost a constant thickness of swab body bulk at any point along the length of the drawstrip 11. FIG. 6 illustrates a second alternative which utilizes an oval shaped swab body 30 also afixable to a drawstrip of the same kind as that shown in FIG. 1 and designated as the drawstrip 11. The oval swab body does not have corners as such and also draws very smoothly through the instrument.

Having now described the invention in connection with particularly illustrated embodiments thereof, modifications and variations of the invention may now naturally occur from time to time to those persons normally skilled in the art without departing from the essential scope or spirit of the invention, and it is intended to claim the same broadly as well as specifically as indicated by the appended claims.

What is claimed is:

1. A musical wind instrument swab for removing moisture from the interior of a musical wind instrument of the type characterized by having a bell end, a barrel end, and an interior air passage extending through the instrument from the bell end to the barrel end, comprising in combination, a) a moisture absorbent washable silk fabric swab body of such configuration and dimensions as to be normally passable through said interior air passage of the wind instrument, b) a swab drawstrip fixedly attached to and extending in opposite directions from said swab body to define a drawstrip leading tail and a drawstrip following tail, each of said tails having a free end, and c) a weight affixed to the said free end of said drawstrip leading tail, said weight being of such dimensions and so affixed to said leading tail that it is freely passable from one end to the other through the interior air passage of the wind instrument with which it is to be used, whereby, the said weighted free end of said leading tail is insertable into the bell end of the instrument to lead and pull the swab through the instrument for emergence at the barrel end, said following tail following the swab body into the instrument and being utilizable in the event of a swab body jam within the instrument to release the jam by back pulling the swab by means of said following tail.

2. A musical wind instrument swab as set forth in claim 1 wherein said swab body is of square shape and wherein said drawstrip is attached thereto along a diagonal of the square, said leading and following tails being portions of said drawstrip extending beyond and free of direct attachment to said swab body.

3. A musical wind instrument swab as set forth in claim 1 wherein said swab body is of rectangle shape and wherein said drawstrip is attached thereto along a diagonal of the rectangle, said leading and following tails being portions of said drawstrip extending beyond and free of direct attachment to said swab body.

4. A musical wind instrument swab as set forth in claim 1 wherein said swab body is of elliptical shape ellipse, and wherein said drawstrip is attached thereto along the major axis of the ellipse, said leading and following tails being portions of said drawstrip extending beyond and free of direct attachment to said swab body.

5. A musical wind instrument swab for removing moisture from the interior of a musical wind instrument of the type characterized by having a bell end, a barrel end, and an interior air passage extending through the instrument from the bell end to the barrel end, comprising in combination, a) a moisture absorbent rectangular swab body normally passable through said interior air passage of the wind instrument, b) a swab drawstrip fixedly attached to and extending in opposite directions from said rectangular swab body along a diagonal of said rectangular swab body to define a drawstrip leading tail and a drawstrip following tail, each of said tails having a free end, and c) a weight affixed to the said free end of said drawstrip leading tail, said weight being of such dimensions and so affixed to said leading tail that it is freely passable from one end to the other through the interior passage of the wind instrument with which it is to be used, whereby, the said weighted free end of said leading tail is insertable into the bell end of the instrument to lead and pull the swab through the instrument for emergence at the barrel end, said following tail following the swab body into the instrument and being utilizable in the event of a swab body jam within the instrument to release the jam by back pulling the swab by means of said following tail.

6. A musical wind instrument swab as set forth in claim 5 wherein said rectangular swab body is square.

7. A musical wind instrument swab for removing moisture from the interior of a musical wind instrument of the type characterized by having a bell end, a barrel end, and an interior air passage extending through the instrument from the bell end to the barrel end, comprising in combination, a) a moisture absorbent elliptical swab body normally passage through said interior air passage of the wind instrument, b) a swab drawstrip fixedly attached to and extending in opposite directions from said elliptical swab body along the major axis of the ellipse to define a drawstrip leading tail and a drawstrip following tail, each of said tails having a free end, and c) a weight affixed to the said free end of said drawstrip leading tail, said weight being of such dimensions and so affixed to said leading tail that it is freely passable from one end to the other through the interior passage of the wind instrument with which it is to be used, whereby, the said weighted free end of said leading tail is insertable into the bell end of the instrument to lead and pull the swab through the instrument for emergence at the barrel end, said following tail following the swab body into the instrument and being utilizable in the event of a swab body jam within the instrument to release the jam by back pulling the swab by means of said following tail.

* * * * *